US007614820B2

(12) United States Patent
Shaw et al.

(10) Patent No.: US 7,614,820 B2
(45) Date of Patent: Nov. 10, 2009

(54) NON-SLICK SURFACE-SEEDED AGGREGATE CONCRETE AND METHOD OF FORMING

(75) Inventors: Ronald D. Shaw, Corona Del Mar, CA (US); Lee A. Shaw, Newport Beach, CA (US)

(73) Assignee: Lithocrete, Inc., Costa Mesa, CA (US)

( * ) Notice: Subject to any disclaimer, the term of this patent is extended or adjusted under 35 U.S.C. 154(b) by 482 days.

(21) Appl. No.: 11/399,999

(22) Filed: Apr. 7, 2006

(65) Prior Publication Data

US 2007/0234652 A1 Oct. 11, 2007

(51) Int. Cl.
*E01C 11/24* (2006.01)

(52) U.S. Cl. ..... 404/20; 404/82; 52/742.1; 52/315

(58) Field of Classification Search ..... 404/72, 404/17, 19, 31, 75, 82, 20; 52/396.02–396.05, 52/742.1, 315

See application file for complete search history.

(56) References Cited

U.S. PATENT DOCUMENTS

| | | | | | |
|---|---|---|---|---|---|
| 2,296,453 | A * | 9/1942 | Saffert | 264/131 |
| 4,443,496 | A * | 4/1984 | Obitsu et al. | 427/140 |
| 4,646,482 | A * | 3/1987 | Chitjian | 451/87 |
| 4,662,972 | A * | 5/1987 | Thompson | 156/279 |
| 4,748,788 | A | 6/1988 | Shaw | |
| 5,494,729 | A * | 2/1996 | Henry et al. | 428/147 |
| 5,794,401 | A | 8/1998 | Shaw | |
| 6,016,635 | A | 1/2000 | Shaw | |
| 6,033,146 | A | 3/2000 | Shaw | |
| 6,444,077 | B1 * | 9/2002 | Fennessy | 156/249 |
| 6,568,146 | B2 * | 5/2003 | Harvey | 52/741.41 |
| 6,779,945 | B2 * | 8/2004 | Saffo, Sr. | 404/118 |
| 7,051,483 | B2 * | 5/2006 | Bamford | 52/414 |
| 7,066,680 | B2 * | 6/2006 | Wiley | 404/75 |
| 2003/0164753 | A1 * | 9/2003 | Gongolas | 340/286.06 |
| 2004/0197548 | A1 * | 10/2004 | Kopystecki | 428/325 |
| 2007/0187873 | A1 * | 8/2007 | Bailey | 264/333 |

OTHER PUBLICATIONS

McConnell et al; "Cement-Aggregate Reaction In Concrete"; Journal of the American Concrete Institute vol. 19, No. 2; Oct. 1947; pp. 93-128.

* cited by examiner

*Primary Examiner*—Raymond W Addie
(74) *Attorney, Agent, or Firm*—Stetina Brunda Garred & Brucker

(57) ABSTRACT

A non-slick surface-seeded exposed aggregate concrete product and method of making the same enhances the coefficient of friction of an exposed surface thereof to reduce undesirable slipping and sliding. Implementations of the present invention are characterized by the use of fine sand and aggregate broadcast over the exposed surface, which surface has been prepared to receive the same. After curing, the exposed surface is then ground and acid-etched to define fissures, cracks, and/or sharp edges of the aggregate. Subsequently finishing steps are performed to produce the non-slick concrete product which may be used for high traffic pedestrian areas where foot gripping and traction are important, such as on stairs, ramps, walkways, courtyards, and the like.

17 Claims, 2 Drawing Sheets

NON-SLICK SURFACE-SEEDED AGGREGATE CONCRETE AND METHOD OF FORMING

CROSS-REFERENCE TO RELATED APPLICATIONS

Not Applicable

STATEMENT RE: FEDERALLY SPONSORED RESEARCH/DEVELOPMENT

Not Applicable

Figure 1:
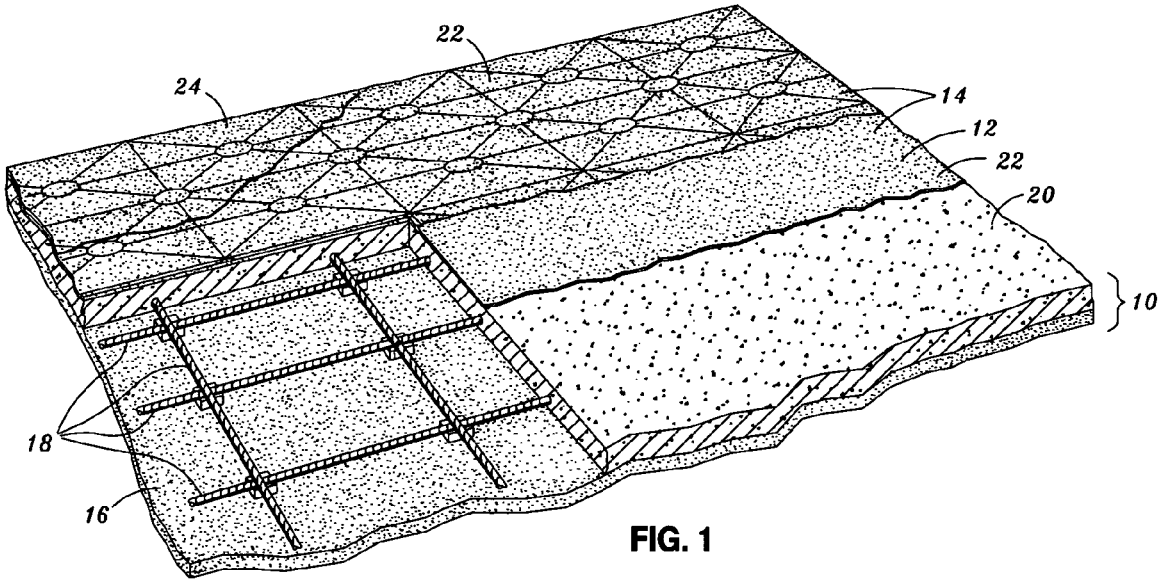

BACKGROUND the present invention relates to exposed aggregate concrete and, more particularly, to an improved non-slick surface-seeded exposed aggregate concrete and method of producing the same.

as is well known, concrete is extensively utilized as a building material for industrial, commercial, and residential applications. Due to its durability, wear resistance and cost economy, concrete has gained widespread use in flooring applications. With this widespread use, Applicants have developed various improvements in concrete flooring products and methods of forming such products. Exemplary improvements include variations in color and surface texture of concrete such that the concrete possesses the aesthetics typical of more costly flooring surfaces such as marble, stone and granite.

In developing innovative improvements to concrete flooring products, Applicants have created many new types of surface-seeded exposed aggregate concrete products and methods of forming the same. Generally, such products are produced by first pouring concrete and then broadcasting or seeding a mass of hard, inert aggregate materials such as sand or gravel over the top surface of the concrete and subsequently troweling the aggregate into the top surface. The aggregate adheres to the concrete and is therefore exposed on the top surface when the concrete cures.

Prior to Applicants' improvements, the surface-seeded exposed aggregate technique required aggregates having a mean size of approximately three-eighths of an inch in diameter or larger. Such large aggregate size was necessary in order to provide sufficient adhesion to the concrete upper cement surface and provide a rough surface to the concrete. Unfortunately, such large aggregate size also limited the widespread use of the technique in flooring applications.

Applicants recognized this deficiency and developed a method to effectively reduce the size of the aggregate exposed on the surface of the concrete, as disclosed in U.S. Pat. No. 4,748,788 entitled "Surface Seeded Exposed Aggregate Concrete and Method of Producing Same" (issued Jun. 7, 1988), hereby incorporated by reference in its entirety. Applicants improved method for producing a decorative slab was comprised of pouring a concrete mixture over a prepared sub grade, finishing the upper surface of the mixture with a bull float, spreading a layer of aggregates less than ⅜ inch in diameter over the mixture, and mixing the two together, applying a chemical retarders, and washing and curing the mixture. The resulting exposed aggregate concrete surface provided improved aesthetics and wear resistance qualities similar to that which is provided by granite, marble or stone flooring.

Applicants later recognized other challenges and developed further improvements to surface-seeded aggregate concrete products. In particular, Applicants developed specific improvements to the above-described technique in Applicants' U.S. Pat. No. 4,748,788. This refined technique, described in Applicants' U.S. Pat. No. 6,016,635, entitled "Surface Seeded Aggregate and Method of Forming the Same" (issued Jan. 25, 2000), facilitated a more uniform top surface texture and greater adhesion of the aggregate thereto and also disclosed the use of glass bead and silica sand as aggregate materials.

Applicants then expanded the variety colors and texture appearances of concrete surfaces produced by the methodology of the surface-seeded exposed aggregate technique of the prior invention. However, one limitation on the variety of surfaces producible was the non-compatibility of certain materials in the concrete mixture. More specifically, scientists reported the occurrence of certain chemical reactions between materials which, over time, degraded the surface. See McConnell et al. "Cement-Aggregate Reaction in Concrete," J. An. Concrete Inst., VII. 19, No. 2, p. 93 (1947). Siliceous materials found in concrete aggregate were known to react with alkalis in Portland cement, creating siliceous gels which lead to expansion, cracking and exudations upon exposed surfaces.

As a result, concrete specifications now typically limit the alkali content in cement to 0.6% in order to inhibit such reactions in concrete aggregates. Minerals other than silicates found in concrete aggregate appear to react to an insignificant extent and are usually deemed innocuous. In response to these problems, Applicants developed a method of precluding the adverse effects of the potential chemical reactions between desired exposed materials in the concrete mixture which is disclosed in Applicants' U.S. Pat. No. 6,033,146, entitled "Glass Chip Lithocrete and Method of Use of Same" (issued Mar. 7, 2000), hereby incorporated by reference in its entirety.

More recently, additional drawbacks associated with concrete flooring products have come to light in certain high traffic areas where foot gripping and traction are important. Such high traffic areas include stairs, ramps, walkways, courtyards, and the like. In particular, various exposed aggregate concrete products may have a slick surface finish which may be undesirable for these high traffic areas. Although slick surface finishes may usually be safe, materials that form slight surface films, such as liquids, dust, dirt, or other such contaminants may lessen the traction of slick surface finishes. The result is a lack of proper grip or traction, which may cause an individual to slide or slip while walking thereupon.

In order to mitigate the risks associated with slick surface finishes, grip strips or tread strips have been used to increase the traction and friction of such surfaces. For example, adhesive floor friction strips or traction tread flooring have been used to provide additional traction for such surfaces. Adhesive floor friction strips may be adhesively secured to the floor and provide a sandpaper-like finish on an exposed portion thereof to enhance the traction of the floor at the location of the friction strip. Traction tread flooring typically includes a metal panel with small raised perforations which contact the sole of an individual's shoe and create additional grip between the sole and the panel. Various other types of gripping surfaces may be retrofitted onto a completed surface in order to improve the traction and friction generated when walking on the surface. Nevertheless, such materials often decrease the aesthetic appeal of the floors and because they are merely additions to the floor, these materials often become dislodged or peel away from the floor as a result of normal wear and tear.

Thus, there exists a substantial need in the art for an improved exposed aggregate concrete finishing technique which is appropriate for high-pedestrian-traffic flooring applications in that the surface has improved traction. There is a need in the art for an attractive flooring surface that does not require the addition of traction-enhancing materials in order to properly ensure adequate traction and gripping on the surface. Finally, there exists a need in the art for a method of producing such surface-seeded exposed aggregate concrete product that has a non-slick surface finish.

BRIEF SUMMARY

A non-slick surface-seeded exposed aggregate concrete product and a method of producing the concrete product upon a sub grade or structure are provided. The method comprises the steps of: pouring a concrete mixture over the sub grade, the concrete mixture defining an exposed surface when poured; finishing the exposed surface of the concrete mixture to dispose a quantity of cement/fines paste derived from the concrete mixture at the exposed surface; broadcasting a quantity of aggregate upon the exposed surface of the concrete mixture; mixing the aggregate into the cement/fines paste; grinding the exposed surface of the concrete mixture; etching the exposed surface, for example, by sandblasting or by applying an acid solution thereto to acid etch the exposed surface; and applying a sealer to the exposed surface.

According to an embodiment of the present invention, the grinding step may include using a concrete grinder. The grinding step may also include grinding the exposed surface to have variable depths. The applying-the-acid-solution step may include applying muriatic acid to the exposed surface. Further, the applying-the-acid-solution step may also include brushing the exposed surface with a scrubbing device. The method may also include a step of rinsing the exposed surface after applying the acid solution to remove the acid solution there from. In fact, the applying the acid solution step may also include the step of allowing the acid solution to etch the exposed surface for at least five minutes prior to removal. The step of rinsing the exposed surface may include applying water to the exposed surface of the concrete mixture.

In addition, the method may further include utilizing a vibrating metal bull float to dispose a quantity of cement/fines paste derived from the concrete mixture at the exposed surface. Furthermore, the mixing aggregate step may include utilizing a vibrating metal bull float to mix the aggregate into the quantity of cement/fines paste. The mixing and finishing steps may also comprise using hand floats, trowels and power trowels to cover said aggregate with said cement/fines paste.

In addition, the method may also including the steps of: washing surface films from the exposed surface; curing the concrete mixture and the cement/fines paste to form a cured mixture and a cured paste; and washing the exposed surface to remove surface residue there from. In an implementation of the present invention, the broadcasting step of the method may include broadcasting fine sand of a given color onto the exposed surface to produce the simulated appearance of quarried stone. Likewise the broadcasting step may also include broadcasting aggregate or reactive aggregate of a given color and any size onto the exposed surface to produce the simulated appearance of quarried stone. Integral aggregate and sands may also be used for the ground and acid etched finish.

Furthermore, the broadcasting step may also include broadcasting fine sand of a given color and aggregate of another given color onto the exposed surface to produce the simulated quarried stone appearance. In this regard, the color of the fine sand and the aggregate may be coordinated to produce the desired appearance. Finally, the method may also include the step of producing a pattern on the exposed surface in a manner to produce the simulated appearance of quarried stone.

Figure 2:
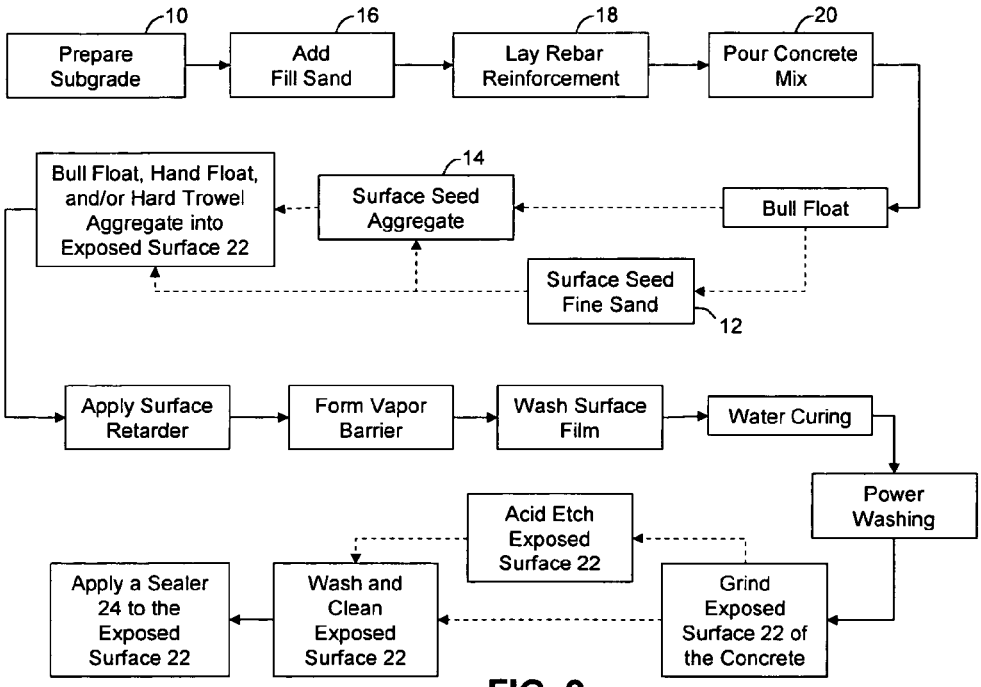

BRIEF DESCRIPTION OF THE DRAWINGS these as well as other features of the present invention will become more apparent upon reference to the drawings wherein:

FIG. 1 is a perspective view illustrating stages of preparation of a non-slick surface-seeded exposed aggregate concrete product produced in accordance with an embodiment of the present invention; and FIG. 2 is schematic diagram illustrating steps of a method for producing the non-slick concrete product in accordance with another embodiment of the present invention.

DETAILED DESCRIPTION

Referring now to the drawings wherein the showings are for purposes of illustrating the preferred embodiments of the invention only, and not for purposes of limiting the same, FIGS. 1-2 illustrate an improved surface-seeded exposed aggregate having a non-slick surface finish and the method of producing the same. Preferred embodiments of the method utilize surface-seeded exposed aggregate disposed upon a sub grade 10, similar to several of the above-mentioned methods. However, the present method incorporates a novel and non-obvious method of producing a non-slick finish on a surface-seeded exposed aggregate concrete product without the use of floor traction products such as adhesive floor traction strips, metal grates, or traction tread flooring.

As will be appreciated by those of skill in the art, as well as those who will use the product and method described herein, the embodiments of the present invention alleviate several of the drawbacks of prior surface-seeded exposed aggregate concrete products and methods. In particular, embodiments of the present invention provide a desirable surface finish having a higher coefficient of friction. With this higher coefficient of friction, individuals who walk on the concrete product will be able to have sure and steady grip without slipping or sliding.

Thus, the concrete product of embodiments of the present invention has a non-slick surface that is an important attribute for high traffic areas where foot gripping and traction are very important, such as on stairs, ramps, walkways, courtyards, and the like. The teachings herein may also be used to modify existing floors to enhance their coefficients of friction as well. Indeed, it is contemplated that various embodiments and implementations of the present invention, whether concrete product or method of making the same, may be utilized in a broad variety of settings and applications.

An implementation of the present invention may be performed after properly preparing the sub grade 10, which may be performed in a variety of ways, utilizing a variety of tools, materials, and methods. One such conventional mode of preparation, as shown in FIG. 2 as the initial step in the method of the present invention, comprises the preparation of the sub grade 10 to a desired elevation and grade and to compact the same preferably a desired compaction level such as to ninety percent (90%) compaction. Subsequent to this preparation, the sub grade 10 may be covered with a layer of clean, moist fill sand 16 which is preferably maintained at a minimum four (4) inch layer thickness.

However, other thicknesses of fill sand 16 may be maintained. Although the fill sand 16 is not absolutely necessary for the method of producing the simulated quarried stone of the present invention, it is highly desirable to control the hydration process of the concrete. In order to increase the resultant strength of the concrete and reduce subsequent cracking of the same, reinforcement members 18 such as a wire mesh or rebar may be positioned upon the layer of fill sand 16. The layer which includes the fill sand 16 and the reinforcement members 18 is often referred to as the sub grade 10.

a concrete mixture 20 is poured over the sub grade 10 such that the reinforcement members 18 are encapsulated within the concrete mixture 20. The concrete mixture 20 is poured to any thickness and preferably to a thickness of approximately a three and one half (3½) to four (4) inches. Although variations in the concrete mixture 20 are contemplated, a preferred concrete mixture 20 comprises seventy percent (70%) sand and thirty percent (30%) three-eighth (⅜) inch mean diameter aggregate combined with six sack cement (2,000 pounds per square inch) or seven sack cement (3,000 pounds per square inch). Dependent on individual tastes, various color mixtures can be added to the concrete mixture 20.

after the concrete mixture 20 has been poured, the concrete mixture 20 is preferably screeded to a desired level plane or grade. The screeding of the concrete mixture 20 results in the same defining a generally level or planer upper exposed surface 22. In the present invention, tamping of the concrete mixture 20 may be omitted in contravention to normal practices in the art. In this respect, it has been determined that tamping should be avoided in implementing embodiments of the present invention so as to avoiding bringing up an excess of cement/fines in the concrete mixture 20 which would be prohibitive for the subsequent surface seeding of the exposed aggregate.

Rather, subsequent to screeding, the exposed surface 22 of the concrete mixture 20 is preferably surfaced or finished to dispose of a quantity of the cement/fine paste derived from the concrete mixture 20 at the exposed surface 22. This finishing may be done utilizing a vibrating bull float or any other suitable means. The vibrating bull float is typically characterized by having an extremely smooth or polished surface which, in addition to bringing up the appropriate amount of cement/fine paste for the subsequent steps of the present invention, also tends to seal the exposed surface 22 of the concrete mixture 20. It is contemplated that this initial finishing step may be completed through the use of a vibrating bull float, such as a vibrating magnesium bull float or a vibrating aluminum bull float. A preferred metal bull float is sold under the trademark HAL200 by the Lievers Holland Co.

According to an aspect of the present invention, as illustrated in FIG. 2, when the exposed surface 22 of the concrete mixture 20 is still in the plastic state, fine sand 12 may be broadcast over the exposed surface 22. The fine sand 12 may be of any given color or texture, as required to produce the simulated appearance of quarried stone. Further, it is contemplated that various combinations of color, texture, or other characteristics of the fine sand 12 may be variously created in order to accurately simulate the appearance of quarried stone. Thus, in some instances, multiple types of fine sand 12 may be utilized in a given project to produce desired aesthetic effects. In other instances, the fine sand 12 may be of a single type.

In this regard, the coloring and/or patterns that may be created utilizing the fine sand 12 are dependant upon the manner in which the fine sand 12 is broadcast upon the exposed surface 22. The fine sand 12 may be utilized to produce an overall shade or color as the simulated appearance of quarried stone, or may be alternated with other colors of the fine sand 12 or quantity thereof to simulate the various aspects of natural quarried stone such as graining, fractures, joints, knots, crystallization patterns, sand seams, streaks, subjoints, weathering, and/or rock texture properties such as porphyritic, ophitic, and orei.

In addition to the broadcasting of the fine sand 12, a quantity of aggregate 14 may also be broadcast upon the exposed surface 22 of the concrete mixture 20. As mentioned above in relation to the fine sand 12, the characteristics of the aggregate 14, such as the color, texture, or size, may be varied as required in order to simulate the appearance of natural quarried stone. Indeed, in order to simulate the flex, speckles, and inclusions of natural quarried stone, it is contemplated that the aggregate 14 may be selected to contrast with the fine sand 12, or alternatively, that the aggregate 14 may be utilized to complement the fine sand 12 and thereby simulate the appearance of natural quarried stone.

As is known in the art, quarried stone may be of various types such as granite, marble, rhinestone, bluestone, and brownstone, to name a few. It is contemplated that the aggregate 14 and fine sand 12 may be matched in various combinations of color, size, pattern, etc., to produce the various effects that natural quarried stone displays such as graining, fractures, joints, knots, crystallization patterns, sand seams, streaks, subjoints, weathering, rock texture properties such as porphyritic, ophitic, and orei, etc. In addition, the quantity of the fine sand 12 and/or the aggregate 14 per unit area may also be varied to simulate natural quarried stone. Finally, it is contemplated that the exposed surface 22 may be cut to a surface design as required to produce the simulated appearance of quarried stone. In this regard, the cuts may be performed according to the requirements of a given project, such as straight cuts, cuts of any geometry, or cuts to simulate the shape and texture of natural quarried stone.

According to an implementation of the present invention, it is contemplated that the broadcasting of the fine sand 12 and the aggregate 14 may be performed utilizing pneumatic equipment. In this regard, the pneumatic equipment may allow an operator more precisely and uniformly place or spread the fine sand 12 and/or aggregate 14 during broadcasting. As was earlier mentioned, the use of pneumatic equipment may allow the fine sand 12 and/or the aggregate 14 to be evenly distributed upon the exposed surface 22. However, it is also contemplated that pneumatic equipment may allow the operator to produce a randomized pattern or a design corresponding to a particular appearance of natural quarried stone. Thus, the appearance of the exposed surface 22 may be enhanced by utilizing various tools such as pneumatic equipment.

After broadcasting upon the exposed surface 22 of the concrete mixture 20, the fine sand 12 and the aggregate 14 are mixed or worked into the exposed surface 22 of the concrete mixture 20, and more particularly are mixed into the cement/fine paste of the exposed surface 22. In implementations of the present invention, this step may be utilized to further enhance the physical placement of the fine sand 12 and the aggregate 14 on the exposed surface 22. It is contemplated that this step may be performed in order to create various effects exhibited by natural quarried stone displays, such as graining, fractures, joints, knots, crystallization patterns, sand seams, streaks, subjoints, weathering.

In addition, additional effects may be produced such as rock texture properties such as porphyritic, ophitic, and orei, etc. This may be accomplished utilizing a power trowel. However, it is contemplated that the mixing may be accomplished utilizing other devices known in the art. This mixing of the fine sand 12 and the aggregate 14 with the cement/fine paste at the exposed surface 22 is also critical to the process of the present invention because it ensures that the fine sand 12 and the aggregate 14 are fully embedded into the cement/fine paste and thus thoroughly adhered or bonded to the exposed surface 22 of the concrete mixture 20 upon resultant curing.

Referring still to FIG. 2, subsequent to the mixing of the fine sand 12 and the aggregate 14 into the cement/fine paste at the exposed surface 22 of the concrete mixture 20, the exposed surface 22 may be finished with a hand or power trowel, a bull float, or a hand float to properly level and finish the exposed surface 22. After the exposed surface 22 is finished, the exposed surface 22 may then be allowed sufficient time to cure.

As illustrated in FIG. 2, subsequent to washing, the concrete mixture 20 may be cured utilizing water alone, as opposed to chemical curing agents, in order to avoid staining of the exposed surface 22. Such water curing may typically be facilitated through the use of a conventional fogger or soaker hose. After a prescribed period of time (e.g., 30 days after initiating the curing process), any surface residue present on the exposed surface 22 may be removed by conventional power washing with an appropriate solution such as a solution of a ninety percent (90%) steam and ten percent (10%) muriatic acid mixture which is applied by a power washer via a high pressure nozzle.

Thereafter, a chemical surface retarder may be sprayed upon the exposed surface 22 to uniformly cover the same. The chemical retarder slows down the hydration process of the concrete mixture 20. The application of the surface retarder to the exposed surface 22 may be followed by the step of finishing the exposed surface 22 of the concrete mixture 20 with the power trowel, for example, to massage the surface retarder into the cement/fine paste having the fine sand 12 and the aggregate 14 mixed therein. This finishing step preferably results in the penetration of the surface retarder into the cement/fine paste a distance below the maximum depth of the fine sand 12 and the aggregate 14.

The penetration of the surface retarder into the cement/fine paste may extend to a depth of at least approximately ⅜ inch in some instances. Advantageously, this particular finishing step may eliminate hard spots in the resulted concrete by facilitating a full mix of the retarder and the cement fine paste. The power trowel preferably used in relation to both this and the previously mentioned step finishes the exposed surface 22 of the concrete mixture 20 in a generally circular motion. Although various conventional surface retarders may be utilized, a superior surface retarder is designated as SPEC AE manufactured by E.L. Moor Co. of Costa Mesa, Calif.

Referring again to FIG. 2, subsequent to the surface retarder being massaged into the cement/fine paste, a vapor barrier may be preferably formed on the exposed surface 22 of the concrete mixture 20. In the preferred embodiment, the formation of the vapor barrier is facilitated by the application of a liquid chemical evaporation reducer to the exposed surface 22 of the concrete mixture 20. A preferred evaporation reducer is sold under the trademark CONFILM by the Concrete Tie Co. of Compton, Calif. An alternative vapor barrier may be formed by covering the exposed surface 22 with four (4) or six (6) millimeters of visquene. The vapor barrier is maintained upon the exposed surface 22 of the concrete mixture 20 for a prescribed period of time which may range from approximately two (2) to twenty-four (24) hours.

When the concrete mixture 20 has cured, the exposed surface 22 thereof may be prepared by cleaning any particulate or residue therefrom, although cleaning is not required in preparation for grinding. The exposed surface 22 may then be ground utilizing a conventional rotary concrete grinder or other suitable device. A concrete grinder serves to minimize surface irregularities, scrape surfaces, and shear material from the exposed surface 22, as well as to expose the aggregate 14. The aggregate 14 may be cut or shorn by the concrete grinder. However, the grinding preferably allows the larger aggregate to maintain a polished appearance while the smaller aggregate and sand are exposed thereby. Thus, the concrete grinder not only tends to create a level surface, but also produces small fissures, cracks, and/or sharp edges in the aggregate 14 of the entire exposed surface 22 due to the exposure of the small aggregate and sand. The grinding thus serves to increase the coefficient of friction of the exposed surface 22 to provide a non-slip pedestrian surface.

The increased coefficient of friction will tend to cause greater traction or friction between the exposed surface 22 and an object, such as a foot or wheel, contacting the exposed surface 22. In this regard, the exposed surface 22 may thus become non-slick. Additionally, the depth of the grinding may be varied in order to achieve different appearances. A variable depth may tend to expose different cross-sections of the aggregate 14 and other details in the exposed surface 22. The depth of the grinding may be determined and established by varying the parameters of the equipment used (grinders/materials). Therefore, the grinding may not only increase the coefficient of friction of the exposed surface 22, but the grinding may also enhance the appearance of the exposed surface 22.

After the exposed surface 22 has been ground to produce a smooth surface and the desired finish and look of the exposed surface 22 has been achieved, the exposed surface 22 may be prepared for etching. Although acid etching is a preferred method, other mechanical methods such as sandblasting, shot blasting, scarifying, are also alternatives, to name a few. However, some of the mechanical methods may fracture the aggregate or dull the appearance of the aggregate, which may be undesirable. The etching process should remove small amounts of the concrete mixture 20 or cement paste from the exposed surface 22, which will in turn, tend to emphasize the small and ubiquitous fissures, cracks, and/or sharp edges formed in the aggregate 14. The small amounts of concrete mixture 20 may thus be removed from the regions immediately surrounding the aggregate 14 to further define the fissures, cracks, and/or sharp edges of the aggregate 14. The removal of the concrete mixture 20 from these small areas will provide additional micro-irregularities that will increase the coefficient of friction of the exposed surface 22 while maintaining the exposed surface 22 as substantially flat and suitable for pedestrian traffic. The exposed surface 22 may therefore become non-slick and prevent the undesirable slipping and sliding characteristics exhibited by exposed aggregate concrete surfaces of the prior art. Therefore, although acid etching may be effective in properly etching the exposed surface 22, other methods such as sandblasting, shot blasting, and scarifying may also be used.

In order to prepare the exposed surface 22 for etching, any particulate remaining from the grinding should preferably be removed. When acid etching is used, proper guidelines must be followed. Selection of the type of acid, as well as the monitoring of the pH and other factors may be performed by one of skill in the art. An acid solution, such as muriatic (hydrochloric) acid, phosphoric acid, or sulfamic acid may be evenly spread onto the exposed surface 22. The acid solution may be spread using a sprinkler or an acid tolerant spraying device. The acid solution may then be worked into the exposed surface 22 using a scrubbing device such as a bristle brush. The acid solution may be allowed a short period of time, such as five to ten minutes, to etch the exposed surface 22. Once the etching is completed, the acid solution may then be rinsed and removed from the exposed surface 22 using a hose to spray water thereon or by a power washer via a high pressure nozzle in order to thus dilute, neutralize, and remove the acid solution.

The diluted acid solution may also be vacuumed using a wet vacuum. The rinsing of the exposed surface 22 should be repeated as necessary. Extreme care should be taken to ensure that the process is performed without causing undesirable chemical reactions, and so that the pH of the exposed surface 22 returns to a normal level.

Once the exposed surface 22 has been ground and acid etched, a sealer 24 may be used to finish the exposed surface 22. Due to the porous nature of the concrete mixture 20, water, chlorides, stains, and other water or oil-based materials may be absorbed through the exposed surface 22 absent the use of the sealer 24. The sealer 24 tends to protect the exposed surface 22 of the non-slick concrete product by preventing the absorption of such materials without trapping moisture in the exposed surface 22. The sealer 24 also enriches the appearance of the exposed surface 22. Further, the sealer 24 is also useful to prevent erosion, staining, abrasion, chipping, and/or of the exposed surface 22, thus ensuring that the integrity of the exposed surface 22 is protected. More particularly, due to the small and ubiquitous fissures, cracks, and/or sharp edges formed in the aggregate 14, the aggregate 14 may tend crumble from the exposed surface 22 without the use of the sealer 24.

The sealer 24 may be a film former, which may advantageously provide a gloss or sheen appearance to the exposed surface 22, or a penetrant, which may penetrate up to four millimeters into the exposed surface 22 and maintain an unaltered appearance of the exposed surface 22. The sealer 24 may be selected to achieve the desired surface appearance of the exposed surface 22 as well as to facilitate future maintenance. It is contemplated that various types of sealers 24 may be used for enhancing the attributes, appearance, and friction of the exposed surface 22.

Advantageously, the resultant non-slick surface-seeded exposed aggregate concrete not only exhibits an extremely flat exposed aggregate surface which is suitable for flooring applications, but also provides sufficient traction for extremely high traffic pedestrian areas where foot gripping is important, such as on stairs, ramps, walkways and courtyards. In this manner, the use of additional floor traction products, such as adhesive floor traction strips, metal grates, or traction tread flooring, is unnecessary. Furthermore, various embodiments of the present invention also provide a desirable surface finish having a higher coefficient of friction. With this higher coefficient of friction, individuals who walk on the concrete product will enjoy sure and steady grip without slipping or sliding.

In addition, the surface texture and color of the exposed surface 22 is such that it approximates the surface color and texture of more conventional flooring surfaces such as stone, granite and marble. This resemblance can be further accentuated by saw cutting the concrete surface into rectangular grids to give the appearance that the individual rectangular squares of the grid were laid in a manner analogous to the arrangement of stone, granite or marble flooring. Thus, the present invention comprises a significant improvement in the art by providing a surface-seeded exposed aggregate concrete that, due to the manipulation of color and size of the aggregate, as well as the grinding of the exposed surface 22, possesses a non-slick surface finish, texture, and color that improves the coefficient of friction and aesthetics of the exposed surface 22.

The above description is given by way of example, and not limitation. Given the above disclosure, one skilled in the art could devise variations that are within the scope and spirit invention disclosed herein, including various ways of creating different textures, colors, patterns, types of stone, etc. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of producing non-slick surface-seeded exposed aggregate upon a subgrade, the method consisting essentially of:

pouring a concrete mixture over the subgrade, the concrete mixture defining an exposed surface when poured;

finishing the exposed surface of the concrete mixture to dispose of a quantity of cement/fines paste derived from the concrete mixture at the exposed surface thereof;

broadcasting a quantity of aggregate upon the exposed surface of the concrete mixture;

mixing the aggregate into the cement/fines paste;

grinding the exposed surface of the concrete mixture for cutting the aggregate to increase a coefficient of friction of the exposed surface;

after the grinding step, etching the exposed surface for emphasizing small fissures, cracks and/or sharp edges formed in the aggregate to increase the coefficient of friction of the exposed surface; and without polishing the ground and etched exposed surface, applying a sealer to the exposed surface.

2. The method of claim 1 wherein the grinding step includes using a concrete grinder.

3. The method of claim 1 wherein the grinding step includes grinding the exposed surface to have variable depths.

4. The method of claim 1 wherein the etching step includes sandblasting the exposed surface to etch the exposed surface.

5. The method of claim 1 wherein the etching step includes brushing the exposed surface with a scrubbing device.

6. The method of claim 1 wherein the etching step includes applying an acid solution to the exposed surface to acid etch the exposed surface.

7. The method of claim 6 muriatic acid is applied to the exposed surface.

8. The method of claim 6 further including the step of rinsing the exposed surface after applying the acid solution to remove the acid solution therefrom.

9. The method of claim 8 wherein the etching step includes allowing the acid solution to etch the exposed surface.

10. The method of claim 8 wherein the step of rinsing of the exposed surface includes applying water to the exposed surface of the concrete mixture.

11. The method of claim 1 further includes utilizing a vibrating float to dispose a quantity of cement/fines paste derived from the concrete mixture at the exposed surface thereof.

12. The method of claim 1 wherein the step of mixing aggregate further includes utilizing a vibrating metal bull float to mix the aggregate into the quantity of cement/fines paste.

13. The method of claim 1 wherein the mixing step comprises using a hand float to cover said aggregate with said cement/fines paste.

14. The method of claim 1 further including the steps of washing surface films from the exposed surface;

curing the concrete mixture and the cement/fines paste to form a cured mixture and a cured paste; and washing the exposed surface to remove surface residue therefrom.

15. The method of claim 1 wherein the broadcasting step includes broadcasting at least one of fine sand, aggregate, and reactive aggregate of a given color onto the exposed surface to produce the simulated appearance of quarried stone, the color of the fine sand and the aggregate being coordinated to produce the simulated appearance of quarried stone.

16. A surface-seeded exposed particulate concrete product formed by the method of claim 1.

17. The method of claim 1 wherein the applying the sealer step comprises applying a film former to the exposed surface or applying a penetrant to the exposed surface.

* * * * *